US009828711B2

(12) United States Patent
Maeda et al.

(10) Patent No.: US 9,828,711 B2
(45) Date of Patent: Nov. 28, 2017

(54) NEEDLE PLATE REPLACEMENT DEVICE WITH LOCK

(71) Applicant: Janome Sewing Machine Co., Ltd., Hachioji-shi, Tokyo (JP)

(72) Inventors: Koji Maeda, Hachioji (JP); Koichi Honda, Hachioji (JP); Yoshitaka Bamba, Hachioji (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 331 days.

(21) Appl. No.: 14/666,651

(22) Filed: Mar. 24, 2015

(65) Prior Publication Data

US 2016/0040342 A1 Feb. 11, 2016

(30) Foreign Application Priority Data

Aug. 8, 2014 (JP) ..... 2014-162196

(51) Int. Cl.
*D05B 75/00* (2006.01)
*D05B 73/12* (2006.01)

(52) U.S. Cl.
CPC ..... *D05B 73/12* (2013.01)

(58) Field of Classification Search
CPC ..... D05B 73/12; D05D 2203/00
USPC ..... 112/260, 168
See application file for complete search history.

(56) References Cited

U.S. PATENT DOCUMENTS 1,262,114 A 4/1918 Smallbone
2,723,638 A 11/1955 Bell
3,011,463 A 12/1961 Fujita
4,395,962 A 8/1983 Odermann
4,493,280 A 1/1985 Bianchi
4,646,665 A * 3/1987 Jimenez ..... D05B 73/12 108/141

(Continued)

FOREIGN PATENT DOCUMENTS

JP 2013-048846 A 3/2013

OTHER PUBLICATIONS

Office Action dated Jan. 29, 2016, issued in counterpart Australian Patent Application No. 2015201232 (5 pages).

(Continued)

*Primary Examiner* — Nathan Durham

(74) *Attorney, Agent, or Firm* — Westerman, Hattori, Daniels & Adrian, LLP

(57) ABSTRACT

A needle plate replacement device including positioning mechanisms provided in an opposing manner in the needle plate and the bed portion, the positioning mechanisms positioning the needle plate to an attaching position in the bed portion; a lock mechanism including a locking member provided in the bed portion and a locked member provided in the needle plate, in which by mounting the needle plate on the attaching position in the bed portion, the locking member and the locked member is locked to each other thus maintaining a locked state; a push-up mechanism provided in the bed portion, the push-up mechanism pushing up the needle plate mounted on the bed portion towards a dismount position above the bed portion; and a release mechanism cancelling the locked state between the locking member and the locked member of the lock mechanism by being interlocked with an operation of the push-up mechanism.

12 Claims, 9 Drawing Sheets

(56) References Cited

U.S. PATENT DOCUMENTS

| | | | | |
|---|---|---|---|---|
| 8,250,999 | B2 * | 8/2012 | Mizuno | D05B 27/02 112/260 |
| 2010/0175601 | A1 * | 7/2010 | Fukao | D05B 73/12 112/260 |
| 2010/0212563 | A1 | 8/2010 | Mizuno | |

OTHER PUBLICATIONS

Extended European Search Report dated Nov. 6, 2015, issued in counterpart European Patent Application No. 15159544.4. (5 pages).
Taiwanese Office Action dated Oct. 28, 2016, issued in Taiwanese Patent Application No. 104108568). (4 pages).

* cited by examiner

NEEDLE PLATE REPLACEMENT DEVICE WITH LOCK

BACKGROUND OF THE INVENTION

1. Field of the Invention

The present disclosure relates to a needle plate replacement device that attaches and detaches a needle plate of a sewing machine to a bed portion of a machine frame and, in particular, relates to a needle plate replacement device with a lock, the needle plate replacement device with a lock being capable of preventing the mounted needle plate from being unexpectedly dislocated.

2. Description of the Related Art

A needle thread catching mechanism and a feeding mechanism, such as a lower shaft that synchronizes with the upper shaft that drives a needle and a hook that is interlocked with the lower shaft, are accommodated inside a bed portion of a sewing machine on which a needle plate is attached. When performing maintenance on the sewing machine, such as coping with troubles related to the above motion mechanisms, there are cases in which the needle plate needs to be detached and attached.

Furthermore, there are cases in which the needle plate is replaced with a needle plate for straight stitch or a needle plate for zigzag stitch in accordance with the purpose of the sewing.

Since the needle plate includes a needle hole through which a needle penetrates, when mounting the needle plate on the sewing machine, the needle hole needs to be accurately positioned at where the needle descends; accordingly, the needle plate needs to be attached while performing accurate positioning with respect to the machine frame of the sewing machine.

There is a needle plate attaching and detaching mechanism for coping with the above issue that has been hitherto known that facilitates attachment and detachment (see Japanese Unexamined Patent Application 2013-48846, for example). The needle plate attaching and detaching mechanism requires no tool such as a screwdriver, includes a releasing mechanism that enables the mounted needle plate to be easily dismounted, and in mounting the needle plate, allows positioning and fixing to be performed with a simple operation.

SUMMARY OF THE INVENTION

However, there are cases in which the needle thread or the bobbin thread becomes tangled while using the sewing machine due to certain kinds of shortcomings. In such a case, the thread becomes entangled to the inner hook inside the needle plate, causing the sewing machine to become locked and the inner hook to jut out. There have been cases in which the inner hook that has jutted out pushed out the needle plate causing an extremely dangerous state.

Furthermore, as in the case of the needle plate attaching and detaching mechanism disclosed in Japanese Unexamined Patent Application 2013-48846, when the needle plate becomes lifted and the needle plate becomes dislocated, a needle plate detection switch detects that the needle plate has been dislocated and, accordingly, safely stops the drive of the sewing machine; however, when the needle plate is dislocated, there is a risk of the inner hook jutting out and the needle becoming stuck in the inner hook or becoming broken.

Furthermore, while the needle plate is held in the bed portion by the force of a needle plate spring, the holding force of the needle plate spring is not as strong as to suppress the inner hook from jutting out. Accordingly, if the needle plate spring were to suppress the inner hook from jutting out, the holding strength of the needle plate spring needs to be excessively strong and additional strength is needed in attaching and detaching the needle plate; accordingly, there is a problem in putting the above into practical use.

The present disclosure is subject to overcome the above issue and an object thereof is to provide a needle plate replacement device with a lock, in which the needle plate replacement device with a lock is capable of reliably locking the needle plate to the bed portion with a simple operation when mounting the needle plate onto the bed portion, and is capable of canceling the locked state and lifting up the needle plate from the bed portion with a simple single-action operation when dismounting the needle plate from the bed portion.

In order to overcome the above issue, an aspect of the present disclosure adopts a needle plate replacement device with a lock, in which the needle plate replacement device with a lock attaches and detaches a needle plate on a bed portion of a sewing machine and is configured so that the needle plate replacement device with a lock includes: positioning mechanisms that are provided in the needle plate and the bed portion so as to oppose each other, the positioning mechanisms positioning the needle plate to an attaching position in the bed portion; a lock mechanism including a locking member provided in the bed portion and a locked member provided in the needle plate, wherein by mounting the needle plate on the attaching position in the bed portion, the locking member and the locked member are locked to each other and a locked state is maintained; a push-up mechanism that is provided in the bed portion, the push-up mechanism pushing up the needle plate that is mounted on the bed portion towards a dismount position above the bed portion; and a release mechanism that cancels the locked state between the locking member and the locked member of the lock mechanism by being interlocked with an operation of the push-up mechanism.

As a specific exemplary embodiment of the lock mechanism according to the aspect of the present disclosure, the locking member of the lock mechanism adopts a configuration that includes a hook-shaped locking claw portion that is provided in the bed portion so as to be capable of reciprocating, and a lock spring that biases the locking claw portion in a locking direction, and in which the locked member of the lock mechanism is suspended down from an underside of the needle plate and includes a lock support plate to which the locking claw portion is locked.

As a specific exemplary embodiment of the release mechanism and the push-up mechanism according to the aspect of the present disclosure, the release mechanism adopts a configuration that includes a releasing member that is provided in the push-up mechanism, and an actuating member that is provided in the locking claw portion and to which the releasing member engages so as to operate the locking claw portion in a direction countering the biasing direction, and the push-up mechanism adopts a configuration that includes a needle plate replace lever that is pivotally mounted on the bed portion, a needle plate replace rod that pushes up an underside of the needle plate upon operation of the needle plate replace lever and that pushes up the needle plate to the dismount position above the bed portion, and a return spring that biases the needle plate replace rod downwards.

As a specific exemplary embodiment of the needle plate replacement device with a lock according to the aspect of the present disclosure, the needle plate replacement device with a lock adopts a configuration that further includes a holding mechanism that holds the needle plate in the attaching position in the bed portion, in which the holding mechanism includes a needle plate spring that is provided on the underside of the needle plate and that includes a bend portion, and an engaging and standing wall that is provided in the bed portion and in which an engagement portion to which the bend portion of the needle plate spring is engaged is formed.

As a specific exemplary embodiment of the holding mechanism according to the aspect of the present disclosure, the holding mechanism adopts a configuration that further includes a lock member that locks the needle plate in the attaching position in the bed portion, and in which the lock member includes a fixing piece that is provided on the underside of the needle plate on a side opposite to the needle plate spring, and a support plate that is provided in the bed portion, the support plate holding a distal end portion of the fixing piece between an upper support wall of the bed portion and the support plate and holding the needle plate so as to allow the needle plate to rotate at a predetermined angle.

In the needle plate replacement device with a lock of the present disclosure, since the positioning mechanisms position the needle plate to the attaching position in the bed portion by a mere press of the needle plate towards the bed portion and since the lock mechanism that maintains the locked state by locking the locking member that is provided in the bed portion and the locked member that is provided in the needle plate to each other, the push-up mechanism that pushes up the needle plate mounted on the bed portion to the dismount position above the bed portion, and the release mechanism that cancels the locked state between the locking member and the locked member of the locking mechanism by being interlocked with the operation of the push-up mechanism are provided, a separate tool such as a screwdriver is not required and not only can the needle plate be mounted on the bed portion with a simple operation and be set in a locked state, in dismounting the needle plate, since the locked state between the locking member and the locked member can be cancelled by being interlocked with the operation of the push-up mechanism, the needle plate can be pushed up to the dismount position above the bed portion and, accordingly, unexpected lift of the needle plate can be prevented.

Furthermore, since the locking member of the lock mechanism includes the hook-shaped locking claw portion provided in the bed portion so as to be capable of reciprocating and includes a lock spring that biases the locking claw portion in the locking direction, and since the locked member of the lock mechanism includes a lock support plate that is suspended down from the underside of the needle plate and into which the locking claw portion is locked, when the needle plate is pushed into the attaching position in the bed portion, the distal end of the locking claw portion abuts against the lower end of the lock support plate, is temporarily moved to a direction opposite the locking direction, and is then locked to the lock support plate; accordingly, in mounting the needle plate on the bed portion, the locking claw portion is locked to the lock support plate and the needle plate can be locked by an operation of just pushing the needle plate from above.

Furthermore, since the push-up mechanism includes the needle plate replace lever that is pivotally mounted on the bed portion, the needle plate replace rod that pushes up the underside of the needle plate and pushes the needle plate to the dismount position above the bed portion upon operation of the needle plate replace lever, and the return spring that biases the needle plate replace rod downwards, and since the release mechanism includes the releasing member provided in the push-up mechanism and the actuating member that is provided in the locking claw portion and that biases the locking claw portion to the direction that counters the biasing direction by being engaged with the releasing member, in the needle plate that is mounted on the bed portion, the locked state of the lock mechanism is cancelled and the needle plate is pushed up to the dismount position with the single action of pushing down the needle plate replace lever; accordingly, dismounting of the needle plate can be carried out in a further easy manner.

DESCRIPTION OF THE PREFERRED EMBODIMENTS

A sewing machine including a needle plate replacement device with a lock according to an exemplary embodiment of the present disclosure will be described next with reference to the drawings illustrated in the exemplary embodiment.

Exemplary Embodiment

Figure 1:
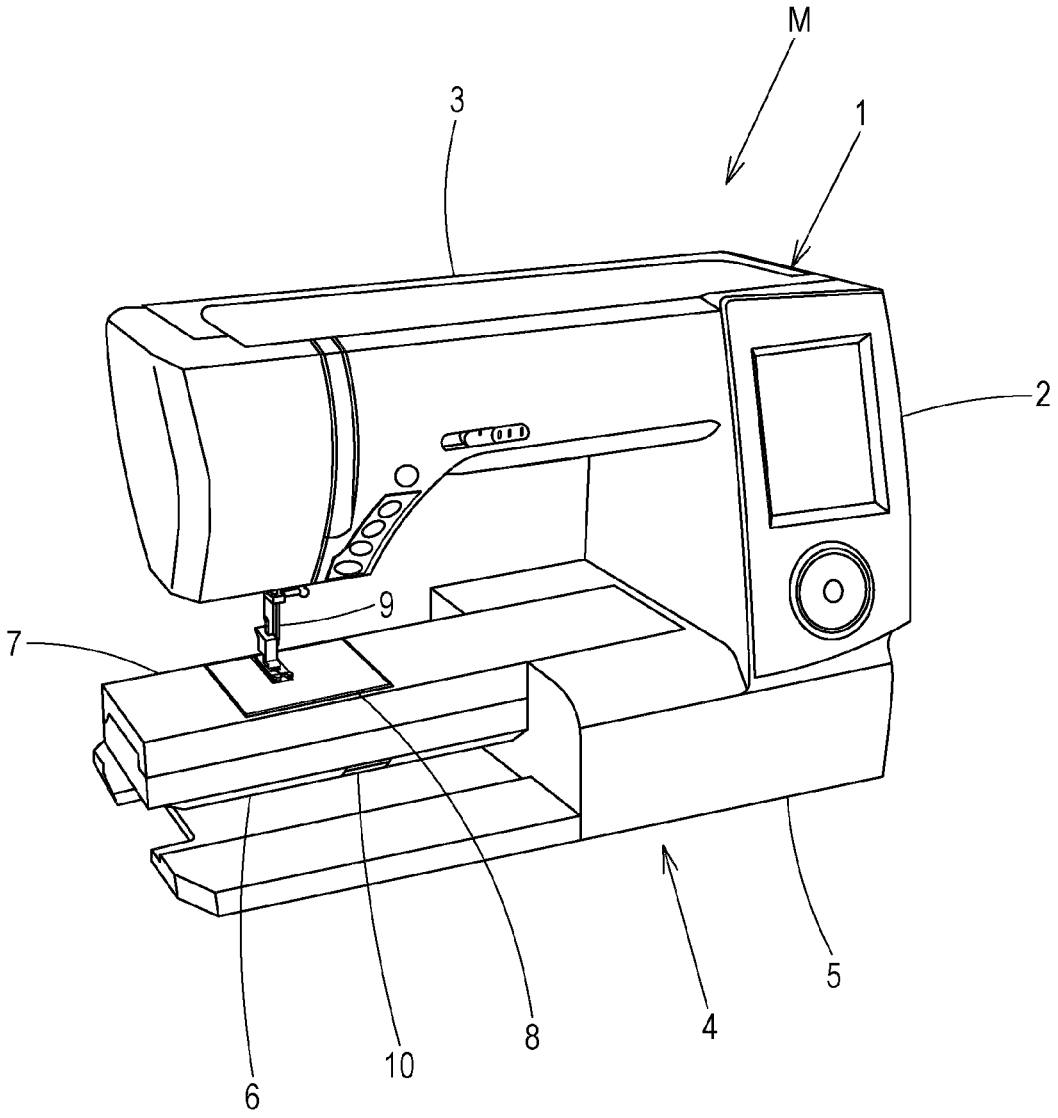
FIG. 1 is a perspective view of an overall sewing machine according to an exemplary embodiment of the present disclosure.

Referring to FIG. 1, reference numeral 1 is an upper frame of a sewing machine M including the needle plate replacement device. The upper frame 1 includes a pillar portion 2 and an arm portion 3 that extends leftwards from the pillar portion 2.

Reference numeral 4 is a bed portion of the sewing machine M and includes a bed base portion 5 and a free arm portion 6 that extends from the bed base portion 5 in a tubular manner.

Reference numeral 7 is a top cover covering an upper opening of the free arm portion 6 and reference numeral 8 is a needle plate that is mounted on the upper surface of the free arm portion 6 in an attachable and detachable manner as described below.

From the arm portion 3 of the upper frame 1, a needle bar, in which a needle 9 is mounted at the distal end thereof, is driven in an up-down direction and the needle 9 is driven and is inserted in a needle hole 8*a* (FIG. 5) of the needle plate 8.

Figure 2:
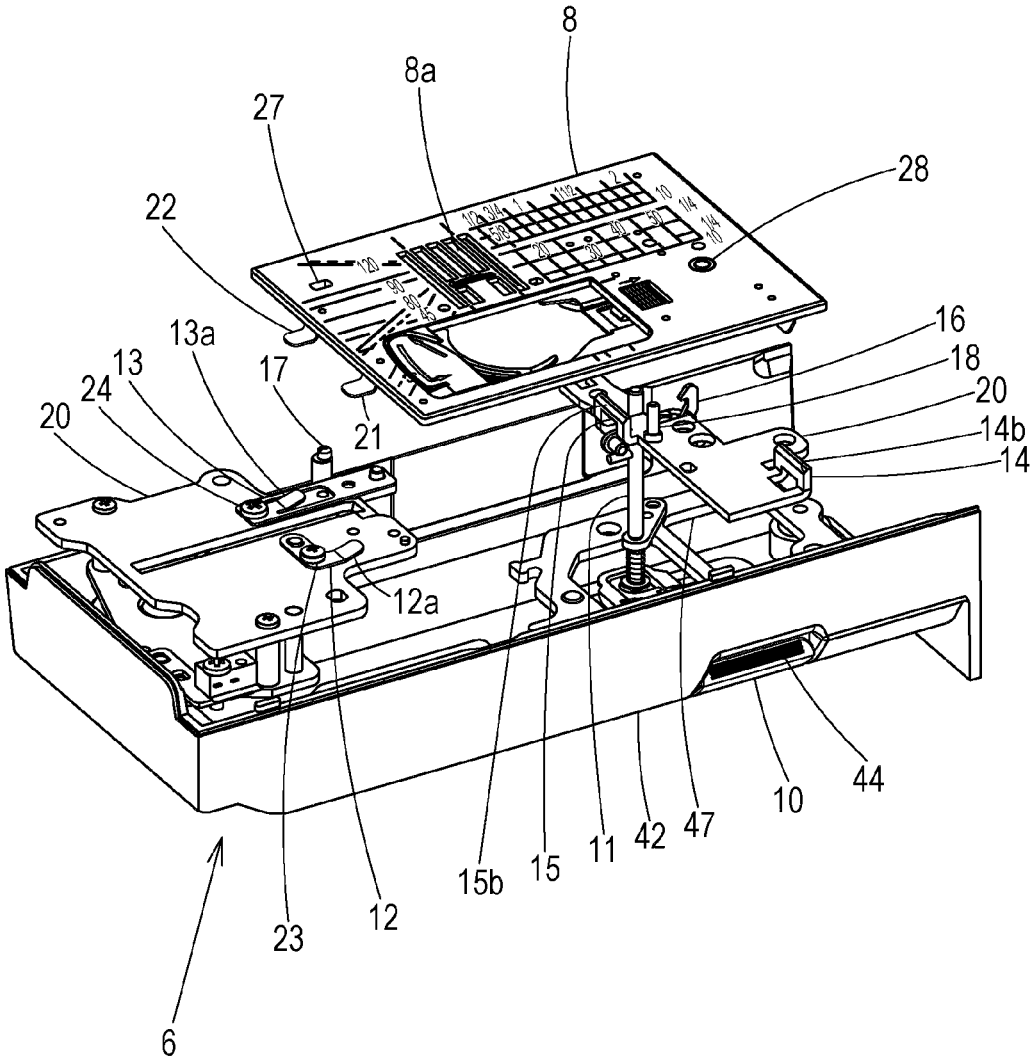
FIG. 2 is an exploded perspective view of a free arm portion in which the top cover of the sewing machine according to the exemplary embodiment of the present disclosure has been removed.
Figure 3:
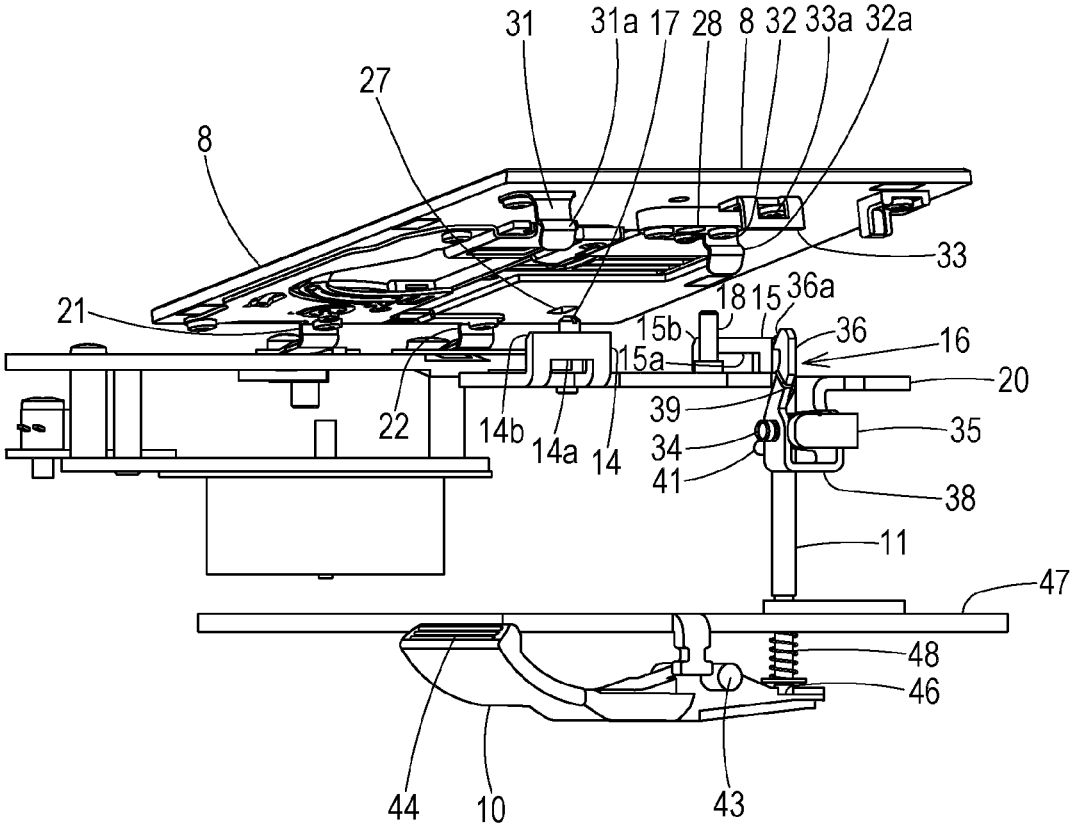
FIG. 3 is a perspective view illustrating a state when a needle plate according to the exemplary embodiment of the present disclosure is mounted on a bed portion.

As illustrated in FIGS. 1 to 3, reference numeral 10 is a needle plate replace lever that is provided in a lower portion of the free arm portion 6 of the bed portion 4 and that operates a needle plate replace rod 11 that pushes the underside of the needle plate 8 upwards.

Support plates 12 and 13 for mounting and holding the needle plate 8, engaging and standing walls 14 and 15, a locking claw portion 16 for locking the mounted and held needle plate 8, and a guide pin 17 and a locating pin 18 for positioning the needle plate 8 when the needle plate 8 is mounted are provided on the upper portion of the free arm portion 6 and are each supported by an upper support wall 20.

As illustrated in FIGS. 2 to 5, fixing pieces 21 and 22 are provided on the needle plate 8 so as to protrude in a lateral direction from one end side of the underside of the needle plate 8.

The support plates 12 and 13 corresponding to the fixing pieces 21 and 22 are fixed to the upper surface of the upper support wall 20 of the free arm portion 6 with screws 23 and 24, respectively, and presser pieces 12*a* and 13*a* that obliquely stand upwards at a predetermined angle are respectively formed in the support plates 12 and 13.

When mounting the needle plate 8 onto the bed portion 4 the fixing pieces 21 and 22 of the needle plate 8 are fitted into portions between the presser pieces 12*a* and 13*a* and the upper surface of the upper support wall 20 so as to function as a lock mechanism.

Figure 4:
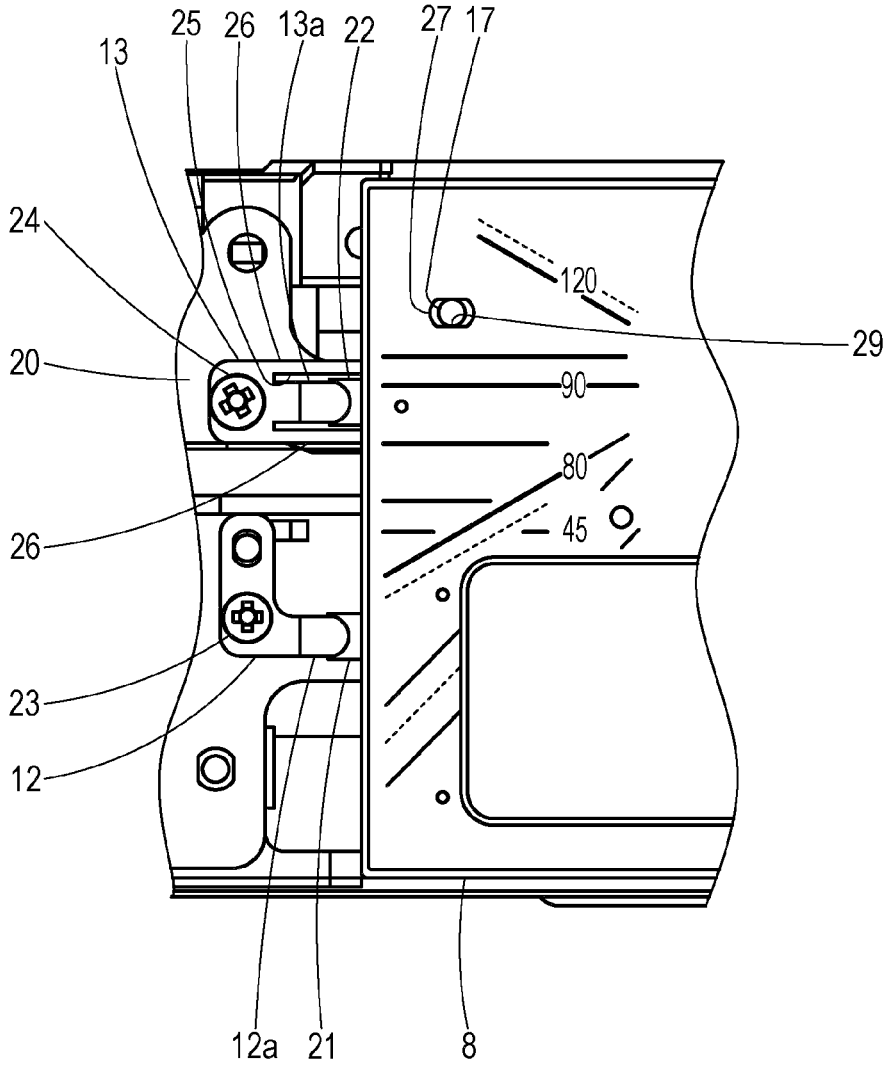
FIG. 4 is a top view illustrating a portion around a support plate into which one end of the needle plate according to the exemplary embodiment of the present disclosure is engaged.

As illustrated in FIG. 4, in the support plate 13, installation portions 26 including insertion guide surfaces 25 that oppose each other at an interval that is slightly wider than the width of the fixing piece 22 are provided at the two sides of the presser piece 13*a*.

In the needle plate 8, a long guide hole 27 is provided at a position that is relatively near the one end side on which the fixing pieces 21 and 22 are provided and a tooling hole 28 is provided at a position that is relatively far from the one end side (in the vicinity of a pushing-up position of the needle plate replace rod 11 described later).

Figure 5A:
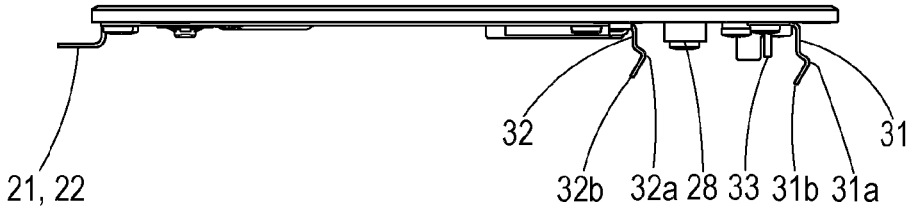
FIG. 5A is a front view of the needle plate of the sewing machine according to the exemplary embodiment of the present disclosure and the FIG. 5B is a bottom (underside) view thereof.
Figure 5B:
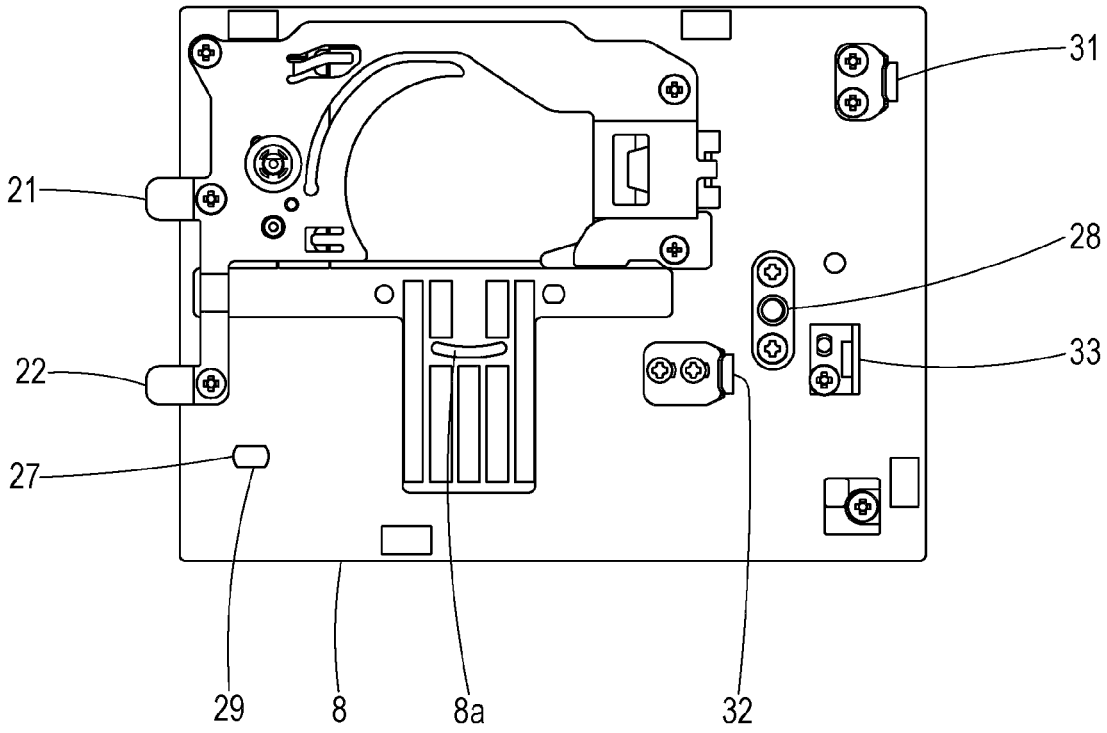

As illustrated in FIGS. 4 and 5B, the long guide hole 27 includes parallel guide surfaces 29. When mounting the needle plate 8, the guide pin 17 is engaged in the long guide hole 27 so as to be capable of sliding along the parallel guide surfaces 29.

As illustrated in FIG. 7, the tooling hole 28 includes a tapered guide surface 30 that widens towards a portion under the needle plate 8 in a cone-like manner. In mounting the needle plate 8, first, the locating pin 18 is abutted against the tapered guide surface 30 and is guided towards the center of the tooling hole 28, and when the locating pin 18 become completely engaged to the tooling hole 28, the ultimate position is determined and the positioning is completed; the above functions as a positioning mechanism.

As illustrated in FIGS. 3 and 5A, in the needle plate 8, needle plate springs 31 and 32 are provided on the underside of a side opposite the one end side on which the fixing pieces 21 and 22 are provided. The needle plate springs 31 and 32 form bend portions 31*a* and 32*a* and are suspended downwards.

Figure 8A:
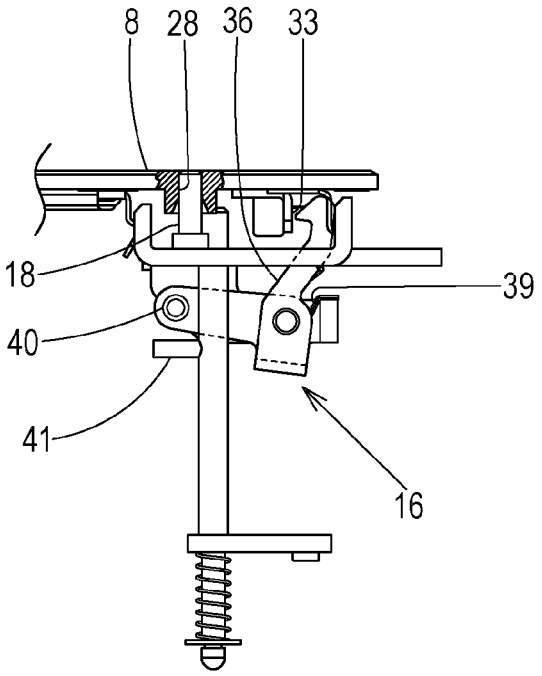
FIG. 8A is an enlarged front view illustrating a state in which the locking claw portion has pivoted while countering an elastic force of the lock spring when the needle plate of the sewing machine according to the exemplary embodiment of the present disclosure is mounted on the bed portion and FIG. 8B is a partially cutaway front view illustrating a state in which the needle plate is mounted on and locked to the bed portion.
Figure 8B:
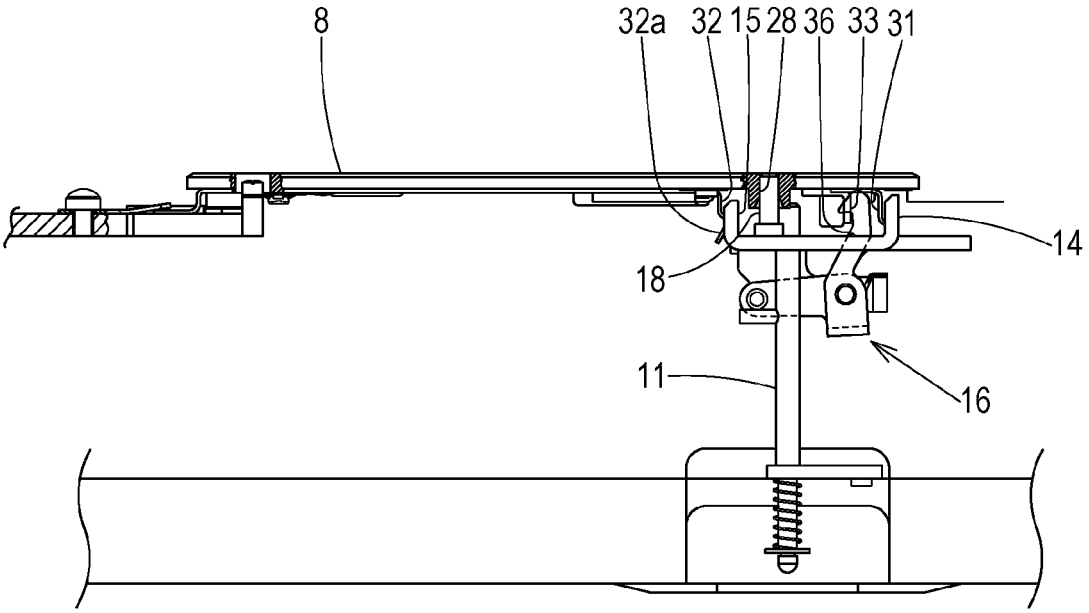

As illustrated in FIG. 8B, in mounting the needle plate 8, each of the bend portions 31*a* and 32*a* of the needle plate springs 31 and 32 are engaged to a corresponding one of engagement portions 14*a* and 15*a* of the engaging and standing walls 14 and 15 (see FIG. 3), and with the exerted elastic force, the bend portions 31*a* and 32*a* function as a holding mechanism that maintains the held state of the needle plate 8.

Note that in the present exemplary embodiment, the engagement portions 14*a* and 15*a* are holes that penetrate the engaging and standing walls 14 and 15; however, the engagement portions 14*a* and 15*a* do not have to be through holes and may be recessed portions or the like, which have been cut out, as long as engagement can be performed with the elastic force exerted by the bend portions 31*a* and 32*a* inserted in the engagement portions 14*a* and 15*a*.

As illustrated in FIGS. 2 and 3, by providing tapered portions 14*b* and 15*b* in the upper end portions of the engaging and standing walls 14 and 15, when pushing the needle plate 8 down in mounting the needle plate 8, the bend portions 31*a* and 32*a* of the needle plate springs 31 and 32 or the tip portions 31*b* and 32*b* thereof come into sliding contact with the tapered portions 14*b* and 15*b*; accordingly, engagement to the engagement portions 14*a* and 15*a* is facilitated.

Furthermore, as described later, when the needle plate 8 is dismounted from the bed portion 4, the bend portions 31*a* and 32*a* or the tip portions 31*b* and 32*b* of the needle plate springs 31 and 32 are supported by the tapered portions 14*b* and 15*b* such that the dismounted state of the needle plate 8 is maintained.

As illustrated in FIG. 3, the needle plate 8 is provided with a lock support plate 33 that is suspended downwards from the underside thereof, and a lock hole 33*a* is formed in the lock support plate 33.

The upper support wall 20 is provided with a mounting plate 35 that is suspended down from an end portion thereof and in which a horizontal spindle 34 is embedded.

The locking claw portion 16 includes a hook-shaped lock claw 36 that extends upwards and an actuation arm 37 that extends in the lateral direction. The lock claw 36 and the actuation arm 37 are connected by a U-shaped connection portion 38.

The connection portion 38 of the locking claw portion 16 is pivotally mounted to the spindle 34 that is embedded in the mounting plate 35 and a lock spring 39 extends across the lock claw 36 and the mounting plate 35.

The locking claw portion 16 is biased by the elastic force of the lock spring 39 so as to pivot in a direction (in the anticlockwise direction in FIGS. 6A to 9B) that locks the lock claw 36 in the lock hole 33*a* of the lock support plate 33; the above functions as a lock mechanism.

Note that in the present exemplary embodiment, although the lock hole 33*a* is formed in the lock support plate 33, the lock hole 33*a* does not necessarily have to be formed in the lock support plate 33 and if the lock claw 36 can be locked to the lower end portion of the lock support plate 33, the cross section of the lower end portion of the lock support plate 33 may have an L-shape.

Furthermore, in the present exemplary embodiment, although the locking claw portion 16 is pivotally mounted to the spindle 34 that is embedded in the mounting plate 35, the locking claw portion 16 does not necessarily have to be pivotally mounted and if the locking claw portion 16 is capable of reciprocating in the direction in which the locking claw portion 16 is locked in the lock support plate 33, the locking claw portion 16 may be a locking claw portion that slides with respect to the upper support wall 20.

An actuation pin 40 is embedded in an end portion of the actuation arm 37, which is an actuating member of the locking claw portion 16, in a parallel manner with respect to the spindle 34. The actuation pin 40 engages with a release pin 41 that is a releasing member that is provided so as to protrude in the lateral direction from a portion midway of the needle plate replace rod 11. The actuation arm 37 that is biased in the locking direction with the elastic force of the lock spring 39 is stopped from pivoting further. The above functions as a release mechanism.

Note that in the present exemplary embodiment, the actuation arm 37 serving as the actuating member is provided in the locking claw portion 16 and the release pin 41 serving as the releasing member is provided in the needle plate replace rod 11; however, the actuating member and the releasing member do not necessarily have to be the actuation arm 37 and the release pin 41 and, as long as the releasing member is, while being interlocked with the needle plate replace rod 11 being pushed up, operable in a direction countering the direction in which the locking claw portion 16 is biased, a cam surface or the like serving as the releasing member may be provided midway of the needle plate replace rod 11 and a follower or the like serving as the actuating member may be provided in the locking claw portion 16.

As illustrated in FIGS. 2 and 3, the needle plate replace lever 10 is attached in a pivotal manner at the lower portion of the free arm portion 6 of the bed portion 4 with a pivot 43 that is provided in a bottom wall 42 in the longitudinal direction of the free arm portion 6.

The needle plate replace lever 10 is provided with, at an end portion thereof that is on the front side with respect to the pivot 43, a finger hooking protrusion 44 for pushing down the needle plate replace lever 10 in the font downward direction by hooking the finger of the operator thereto, and is provided with, on the rear side with respect to the pivot 43 that is on the opposite side of the finger hooking protrusion 44, an abutting portion 46 that is in contact with the lower end portion 45 of the needle plate replace rod 11 and that moves the needle plate replace rod 11 in the up-down direction.

The needle plate replace rod 11 is biased downwards with a return spring 48 supported by a lower support wall 47 of the free arm portion 6, and while the upper end of the needle plate replace rod 11 pushes up the side of the needle plate 8 that is opposite to the one end side on which the fixing pieces 21 and 22 are provided, the lower end portion 45 of the needle plate replace rod 11 is constantly in contact with the abutting portion 46 of the needle plate replace lever 10. The above functions as a push-up mechanism.

Use modes and effects of the present exemplary embodiment will be described next.

Figure 6A:
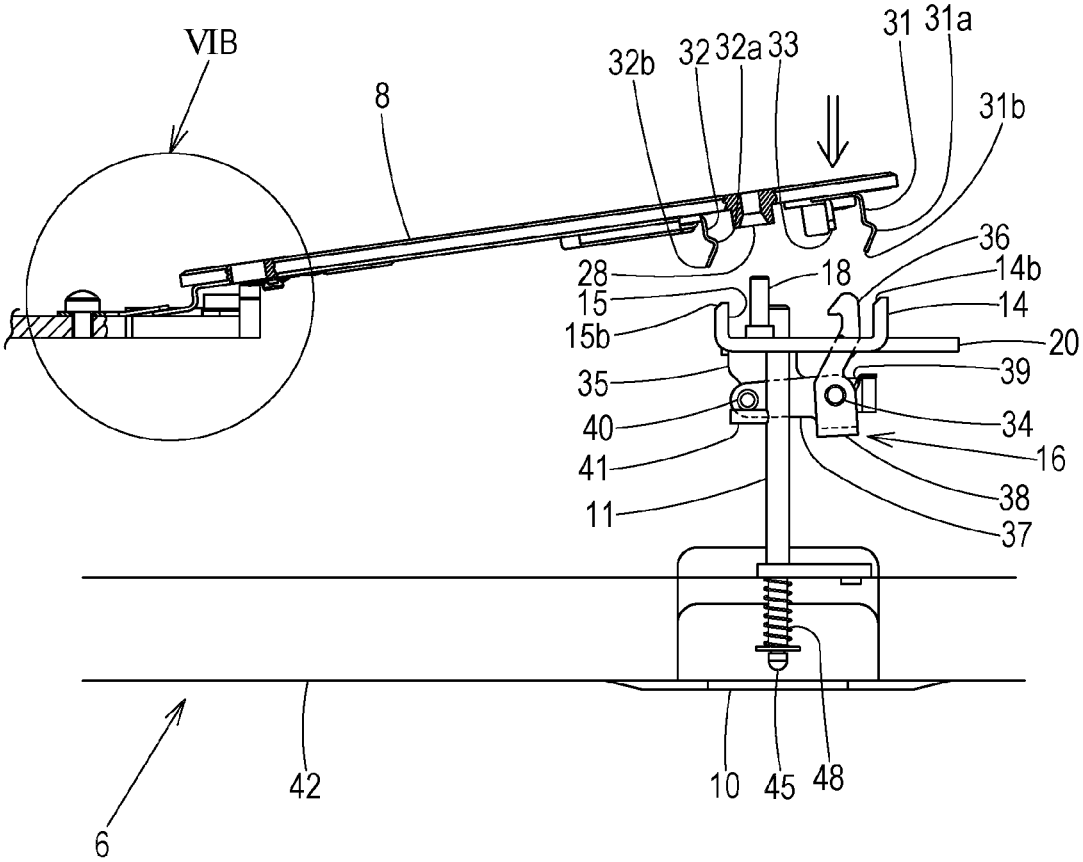
FIG. 6A is a partially cutaway front view illustrating a state when the needle plate of the sewing machine according to the exemplary embodiment of the present exemplary embodiment is mounted on the bed portion and FIG. 6B is an enlarged view of an essential part illustrating a portion around the support plate into which one end of the needle plate of FIG. 6A is engaged.
Figure 6B:
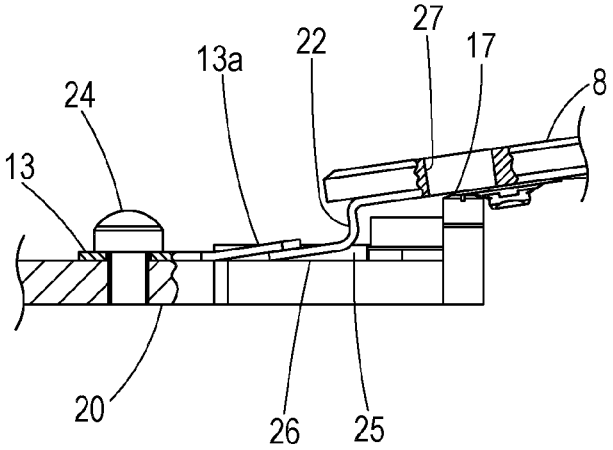

As illustrated in FIG. 6, in mounting the needle plate 8 on the bed portion 4, first, the distal ends of the fixing pieces 21 and 22 provided on one end side of the needle plate 8 are made to be in slide contact with the upper surface of the upper support wall 20 from the front side of the support plates 12 and 13, and the fixing piece 22 is slid along the insertion guide surfaces 25 of the installation portions 26 provided in the support plate 13 such that the fixing piece 22 is engaged between the presser piece 13*a* and an upper fixing surface formed with the upper surface of the upper support wall 20.

As illustrated in FIG. 4, the insertion guide surfaces 25 oppose each other at an interval that is slightly wider than the width of the fixing piece 22 and guides the distal ends of the fixing pieces 21 and 22 to the fixing positions so as to serve a first positioning function that determines the position of one end of the needle plate 8.

The installation portions 26 including the insertion guide surfaces 25 may be provided in the support plate 12 as well; however, providing two pairs of installation portions 26 that each require accurate engagement does not necessarily provide good operability and from the cost side as well, it is desirable that the installation portions 26 including the insertion guide surfaces 25 are provided on either one of the support plates 12 and 13.

The presser pieces 12*a* and 13*a* form inclined surfaces that stand upwards at a predetermined angle, and hold the fixing pieces 21 and 22 that have been engaged between the presser pieces 12*a* and 13*a* and the upper surface of the upper support wall 20 in a rotatable manner at a predetermined angle about a virtual axis of rotation formed in the distal ends of the fixing pieces 21 and 22.

Owing to the insertion guide surfaces 25 and the presser pieces 12*a* and 13*a*, since the position of the virtual axis of rotation formed by the distal ends of the fixing pieces 21 and 22 substantially matches the positions of one end portions of the fixing positions, when the needle plate 8 is pushed down from above the side that opposes the one end side provided with the fixing pieces 21 and 22 so as to push the needle plate 8 against the upper portion of the bed portion 4 in a direction indicated by the arrow in FIG. 6A, the guide pin 17 can easily be engaged in the long guide hole 27 that is provided relatively near the fixing pieces 21 and 22 side of the needle plate 8.

Figure 7A:
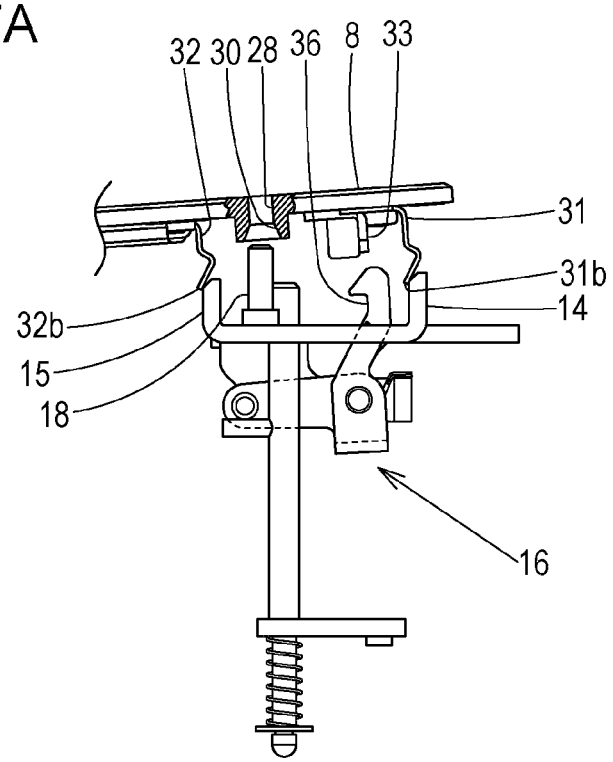
FIG. 7A is an enlarged front view illustrating a state in which tips of the needle plate springs are abutted against tapered portions of the engaging and standing walls when the needle plate of the sewing machine according to the exemplary embodiment of the present disclosure is mounted on the bed portion and FIG. 7B is an enlarged front view illustrating a state in which the impingement portion of the lock support plate is abutted against an inclined portion of the lock claw.

When the needle plate 8 is further pushed down, as illustrated in FIG. 7A, the distal end of the locating pin 18 becomes abutted against the tooling hole 28 provided relatively far from the fixing pieces 21 and 22 side.

Figure 7B:
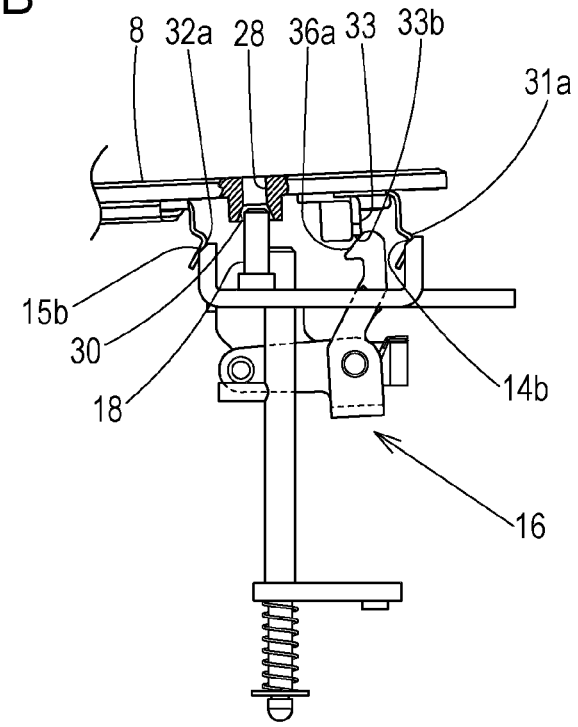

From the above state, when the needle plate 8 is pushed down further, as illustrated in FIG. 7B, the needle plate 8 moves along the path of contact with the tapered guide surface 30 such that the locating pin 18 coincides with the center of the tooling hole 28.

At this moment, as illustrated in FIG. 4, since the parallel guide surfaces 29 that are substantially perpendicular to the virtual axis of rotation are formed in the long guide hole 27, as the locating pin 18 engages into the tooling hole 28, the guide pin 17 slides along the parallel guide surfaces 29 of the long guide hole 27; accordingly, the needle plate 8 can be guided to a precise fixing position.

As described above, since the long guide hole 27 and the tooling hole 28 engage with the guide pin 17 and the locating pin 18, respectively, and since the final position is determined by coordination between the long guide hole 27 and the tooling hole 28, it is desirable that the long guide hole 27 and the tooling hole 28 are spaced apart from each other in the direction parallel to the virtual axis of rotation and that the long guide hole 27 and the tooling hole 28 are not disposed on the same line that is perpendicular to the virtual axis of rotation.

In the course of pushing down the needle plate 8, as illustrated in FIG. 7A, the tip portions 31*b* and 32*b* of the needle plate springs 31 and 32 provided in the lower portion of the needle plate 8 become abutted against the tapered portions 14*b* and 15*b* formed in the upper end portion of the engaging and standing walls 14 and 15.

When the needle plate 8 is further pushed down, as illustrated in FIG. 7B, the bend portions 31*a* and 32*a* of the needle plate springs 31 and 32 being elastically deformed are moved downwards while brought into slide contact with the tapered portions 14*b* and 15*b*.

At the same time as above, an impingement portion 33*b* of the lock support plate 33 provided on the underside of the needle plate 8 abuts against an inclined surface 36*a* formed on the upper portion of the lock claw 36 and, as illustrated in FIG. 8A, the locking claw portion 16 is pivoted in the clockwise direction so as to counter the direction in which the locking claw portion 16 is biased by the elastic force of the lock spring 39.

With the tapered guide surface 30, when the needle plate 8 is moved to a position where the center of the tooling hole 28 coincides with the center of the locating pin 18, the tooling hole 28 becomes completely engaged with the locating pin 18 and the needle plate 8 finishes the positioning process and is mounted on the fixing surface of the bed portion 4.

At this time, as illustrated in FIG. 8B, the bend portions 31*a* and 32*a* of the needle plate springs 31 and 32 engage with the engagement portions 14*a* and 15*a* of the engaging and standing walls 14 and 15, and with the elastic force thereof, the needle plate 8 can be held in the fixing position in the bed portion 4.

At the same time as above, the needle plate 8 that is held in the fixing position in the bed portion 4 can be in a locked state by locking the lock claw 36 of the locking claw portion 16 to the lock hole 33*a* formed in the lock support plate 33.

As described above, in the present exemplary embodiment, in mounting the needle plate 8 onto the bed portion 4, by just inserting the fixing pieces 21 and 22 provided on the one end side of the needle plate 8 into the support plates 12 and 13 and by just pushing down from above the side that is opposite the one end side provided with the fixing pieces 21 and 22, positioning can be performed and the needle plate 8 can be mounted and fixed onto the bed portion 4. Further, with a simple attaching operation, the needle plate 8 can be firmly locked in a locked state, thus preventing itself from being unexpectedly lifted.

An operation of dismounting the needle plate 8 from the bed portion 4 will be described next in which the locked state of the mounted needle plate 8 is canceled and in which the needle plate 8 is pushed up to a dismount position above the bed portion 4.

As illustrated in FIG. 3, in the needle plate replace lever 10 that is attached to the lower portion of the bed portion 4 with the pivot 43, the abutting portion 46 disposed in the vicinity of one of the end portions with respect to the pivot 43 is, when in a non-operated state in which the needle plate 8 is installed in the fixing position, pushed down by the lower end portion 45 of the needle plate replace rod 11 that is biased downwards by the elastic force of the return spring 48; accordingly, the finger hooking protrusion 44 that is provided on the other end portion with respect to the pivot 43 is accommodated at a position along the outer periphery of the bottom wall 42 of the bed portion 4.

In order to dismount the needle plate 8, the finger hooking protrusion 44 of the needle plate replace lever 10 is pushed down by a finger that is hooked thereto such that the needle plate replace lever 10 is pivoted in the anticlockwise direction in FIG. 3 about the pivot 43 so that the abutting portion 46 ascends inside the bed portion 4 and, while countering the elastic force of the return spring 48, pushes up the lower end portion 45 of the needle plate replace rod 11.

Figure 9A:
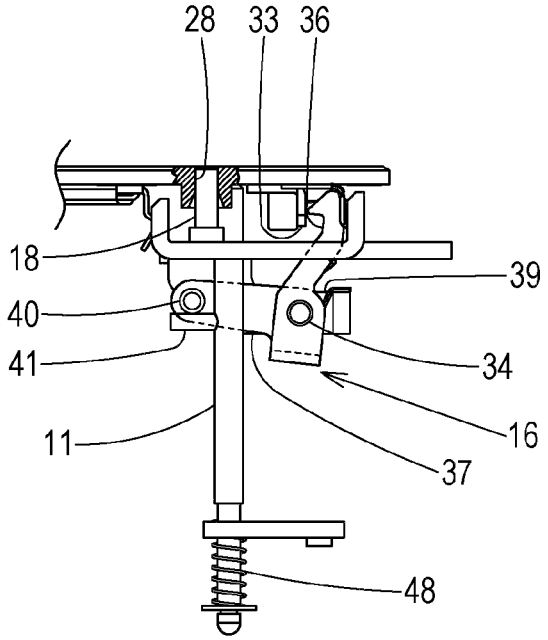
FIG. 9A is an enlarged front view illustrating a state in which the needle plate replace rod is pushed up and the lock of the locking claw portion is canceled when the needle plate of the sewing machine according to the exemplary embodiment of the present disclosure is dismounted from the bed portion and FIG. 9B is an enlarged front view illustrating a state in which the needle plate replace rod has pushed up the underside of the needle plate.

By pushing down the needle plate replace lever 10, when the upper end of the needle plate replace rod 11 is pushed up to a position proximate to where the upper end of the needle plate replace rod 11 abuts against the underside of the needle plate 8, as illustrated in FIG. 9A, the release pin 41 that is provided in a protruding manner midway of the needle plate replace rod 11 pushes up the actuation pin 40 that is embedded in the actuation arm 37 of the locking claw portion 16 such that the locking claw portion 16, countering the elastic force of the lock spring 39, is pivoted clockwise.

With the pivoting of the locking claw portion 16, the lock claw 36 is released from the lock hole 33*a* of the lock support plate 33 such that the locked state of the needle plate 8 mounted on the bed portion 4 is canceled.

Furthermore, by pushing down the needle plate replace lever 10, the needle plate replace rod 11 is pushed up such that the upper end of the needle plate replace rod 11 abuts against the under surface of the needle plate 8; accordingly, a force that pushes up the needle plate 8 acts thereon.

In such a case, when the force pushing up the needle plate replace rod 11 that acts on the needle plate 8 surpasses the elastic force of the needle plate springs 31 and 32, the locked state between the locking claw portion 16 and the lock support plate 33 is canceled and, accordingly, the needle plate 8 starts to pivot upwards about the virtual axis of rotation of the distal ends of the fixing pieces 21 and 22 held by the support plates 12 and 13, and the bend portions 31*a* and 32*a* of the needle plate springs 31 and 32 are separated from the engagement portions 14*a* and 15*a* of the engaging and standing walls 14 and 15 such that the engagement is released.

Figure 9B:
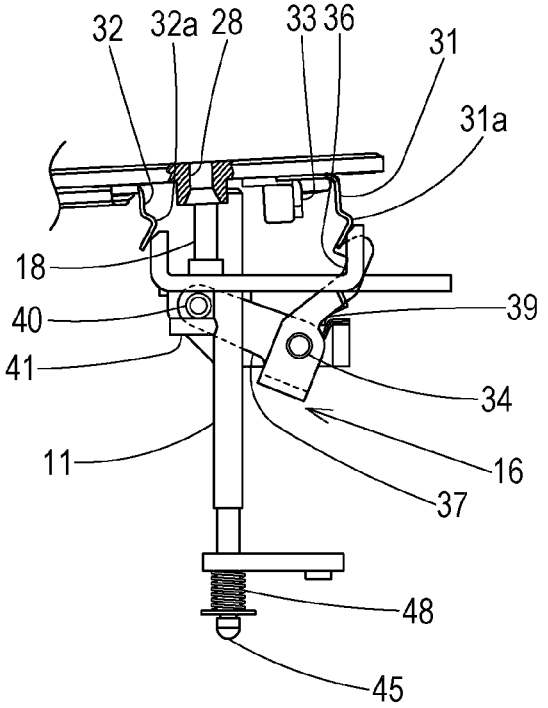

When the needle plate replace lever 10 is further pushed down, the needle plate replace rod 11 pushes up the needle plate 8 and, as illustrated in FIG. 9B, the needle plate springs 31 and 32 become completely separated from the engaging and standing walls 14 and 15 such that the needle plate 8 is pushed upwards to the dismount position so as to return to the state before being mounted.

Subsequently, even if the hand is removed from the needle plate replace lever 10 and the needle plate replace rod 11 becomes lowered to the non-operation position, as illustrated in FIG. 7A, since the needle plate springs 31 and 32 are restored to their original shapes and the tip portions 31*b* and 32*b* thereof are maintained in a state in which the tip portions 31*b* and 32*b* sit on the tapered portions 14*b* and 15*b* of the engaging and standing walls 14 and 15, the needle plate 8 does not return to the fixing position and does not adhere to the fixing surface of the bed portion 4; accordingly, it will be possible to easily dismount the needle plate 8 by hand.

As described above, in the present exemplary embodiment, in dismounting the needle plate 8 from the bed portion 4, a separate tool is not required and the needle plate 8 is dismounted with just a single-touch action of manually operating the needle plate replace lever 10 and, further, even if the hand is removed from the needle plate replace lever 10, the dismounted state can be maintained; accordingly, dismounting of the needle plate 8 is facilitated.

As described above, in the needle plate replacement device with a lock of the present exemplary embodiment, by just inserting the fixing pieces 21 and 22 provided on the one end side of the needle plate 8 into the support plates 12 and 13 and by just pushing down, from above, the side opposite the one end side provided with the fixing pieces 21 and 22, the needle plate 8 can be positioned and mounted and can be in a locked state that can prevent the needle plate 8 from being lifted unexpectedly and, further, the locked state can be canceled and the needle plate 8 can be dismounted by just manually operating the needle plate replace lever 10; accordingly, the attachment and detachment of the needle plate 8 can be carried out most easily.

Note that in the present exemplary embodiment, the needle plate 8 is attached to the free arm portion 6 of the bed portion 4; however, the present disclosure is not limited to a sewing machine that includes a free arm portion such as the one described above and, naturally, may be applied to sewing machines including various forms of bed portions.

Furthermore, the lock mechanism constituted by the support plates 12 and 13 and the fixing pieces 21 and 22 of the present exemplary embodiment guides and maintains the needle plate 8 at the mount position and the dismount position and enables efficient operation; however, the above is not necessarily required in the present disclosure and the holding mechanism is not limited to the form of engagement including the needle plate springs 31 and 32 and the engagement portions 14*a* and 15*a* of the present exemplary embodiment and various forms of engagement known in the art may be used as long as the needle plate 8 can be fixed by just pushing down the needle plate 8 and the needle plate 8 can be dismounted by just pushing up the needle plate 8.

The needle plate replacement device with a lock of the present disclosure is capable of dismounting the mounted needle plate by canceling the locked state with an operation of a single action and is capable of positioning and mounting the needle plate and setting the needle plate in a locked state with a simple operation; accordingly, replacement of the needle plate and maintenance of the lower shaft motion mechanism can be carried out efficiently and the needle plate replacement device can be advantageously and widely applied to various types of sewing machines.

What is claimed is:

1. A needle plate replacement device with a lock that attaches and detaches a needle plate on a bed portion of a sewing machine, the needle plate replacement device with a lock comprising:

positioning mechanisms that are provided in the needle plate and the bed portion so as to oppose each other, the positioning mechanisms positioning the needle plate to an attaching position in the bed portion;

lock mechanism including a locking member provided in the bed portion and a locked member provided in the needle plate, wherein by mounting the needle plate on the attaching position in the bed portion, the locking member and the locked member are locked to each other and a locked state is maintained;

a push-up mechanism that is provided in the bed portion, the push-up mechanism pushing up the needle plate that is mounted on the bed portion towards a dismount position above the bed portion; and a release mechanism that cancels the locked state between the locking member and the locked member of the lock mechanism when the push-up mechanism is operated, wherein the locking member of the lock mechanism includes a hook-shaped locking claw portion that is provided in the bed portion so as to be capable of reciprocating, and a lock spring that biases the locking claw portion in a locking direction, and the locked member of the lock mechanism is suspended down from an underside of the needle plate and includes a lock support plate to which the locking claw portion is locked.

2. The needle plate replacement device with a lock according to claim 1, wherein the release mechanism includes a releasing member that is provided in the push-up mechanism, and an actuating member that is provided in the locking claw portion and to which the releasing member engages so as to operate the locking claw portion in a direction countering the biasing direction.

3. The needle plate replacement device with a lock according to claim 1, wherein the push-up mechanism includes a needle plate replace lever that is pivotally mounted on the bed portion, a needle plate replace rod that pushes up an underside of the needle plate upon operation of the needle plate replace lever and that pushes up the needle plate to the dismount position above the bed portion, and a return spring that biases the needle plate replace rod downwards.

4. The needle plate replacement device with a lock according to claim 3, wherein the release mechanism includes a releasing member that is provided in the push-up mechanism, and an actuating member that is provided in the locking claw portion and to which the releasing member engages so as to operate the locking claw portion in a direction countering the biasing direction.

5. The needle plate replacement device with a lock according to claim 3, further comprising a holding mechanism that holds the needle plate in the attaching position in the bed portion, wherein the holding mechanism includes a needle plate spring that is provided on the underside of the needle plate and that includes a bend portion, and an engaging and standing wall that is provided in the bed portion and in which an engagement portion to which the bend portion of the needle plate spring is engaged is formed.

6. The needle plate replacement device with a lock according to claim 5, wherein the release mechanism includes a releasing member that is provided in the push-up mechanism, and an actuating member that is provided in the locking claw portion and to which the releasing member engages so as to operate the locking claw portion in a direction countering the biasing direction.

7. The needle plate replacement device with a lock according to claim 5, wherein the holding mechanism further includes a lock member that locks the needle plate in the attaching position in the bed portion, and the lock member includes a fixing piece that is provided on the underside of the needle plate on a side opposite to the needle plate spring, and a support plate that is provided in the bed portion, the support plate holding a distal end portion of the fixing piece between an upper support wall of the bed portion and the support plate and holding the needle plate so as to allow the needle plate to rotate at a predetermined angle.

8. The needle plate replacement device with a lock according to claim 7, wherein the release mechanism includes a releasing member that is provided in the push-up mechanism, and an actuating member that is provided in the locking claw portion and to which the releasing member engages so as to operate the locking claw portion in a direction countering the biasing direction.

9. The needle plate replacement device with a lock according to claim 1, further comprising a holding mechanism that holds the needle plate in the attaching position in the bed portion, wherein the holding mechanism includes a needle plate spring that is provided on the underside of the needle plate and that includes a bend portion, and an engaging and standing wall that is provided in the bed portion and in which an engagement portion to which the bend portion of the needle plate spring is engaged is formed.

10. The needle plate replacement device with a lock according to claim 1, wherein the release mechanism includes a releasing member that is provided in the push-up mechanism, and an actuating member that is provided in the locking claw portion and to which the releasing member engages so as to operate the locking claw portion in a direction countering the biasing direction.

11. The needle plate replacement device with a lock according to claim 9, wherein the holding mechanism further includes a lock member that locks the needle plate in the attaching position in the bed portion, and the lock member includes a fixing piece that is provided on the underside of the needle plate on a side opposite to the needle plate spring, and a support plate that is provided in the bed portion, the support plate holding a distal end portion of the fixing piece between an upper support wall of the bed portion and the support plate and holding the needle plate so as to allow the needle plate to rotate at a predetermined angle.

12. The needle plate replacement device with a lock according to claim 11, wherein the release mechanism includes a releasing member that is provided in the push-up mechanism, and an actuating member that is provided in the locking claw portion and to which the releasing member engages so as to operate the locking claw portion in a direction countering the biasing direction.

* * * * *